US007857060B2

(12) United States Patent
Thompson

(10) Patent No.: US 7,857,060 B2
(45) Date of Patent: Dec. 28, 2010

(54) SYSTEM, METHOD AND APPARATUS FOR CONCENTRIC TUBING DEPLOYED, ARTIFICIAL LIFT ALLOWING GAS VENTING FROM BELOW PACKERS

(75) Inventor: David Thompson, Banchory (GB)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/248,930

(22) Filed: Oct. 10, 2008

(65) Prior Publication Data

US 2010/0089588 A1 Apr. 15, 2010

(51) Int. Cl.
*E21B 43/12* (2006.01)

(52) U.S. Cl. ..... 166/370; 166/105.5

(58) Field of Classification Search ..... 166/105.5, 166/265, 311, 370
See application file for complete search history.

(56) References Cited

U.S. PATENT DOCUMENTS

| | | | | |
|---|---|---|---|---|
| 3,620,571 | A | 11/1971 | Billings | |
| 3,894,583 | A | 7/1975 | Morgan | |
| 4,275,790 | A * | 6/1981 | Abercrombie | 166/372 |
| 4,615,387 | A * | 10/1986 | Johnson et al. | 166/242.1 |
| 4,934,458 | A * | 6/1990 | Warburton et al. | 166/370 |
| 5,389,128 | A | 2/1995 | Lopes | |
| 5,417,281 | A | 5/1995 | Wood et al. | |
| 5,431,228 | A | 7/1995 | Weingarten et al. | |
| 5,474,601 | A * | 12/1995 | Choi | 96/182 |
| 5,522,463 | A | 6/1996 | Barbee | |
| 6,135,210 | A * | 10/2000 | Rivas | 166/372 |
| 6,179,056 | B1 | 1/2001 | Smith | |
| 6,382,315 | B1 * | 5/2002 | Langseth | 166/252.1 |
| 6,394,182 | B1 | 5/2002 | Fadel | |
| 6,497,290 | B1 | 12/2002 | Misselbrook et al. | |
| 6,550,535 | B1 * | 4/2003 | Traylor | 166/265 |
| 6,651,740 | B2 * | 11/2003 | Kobylinski et al. | 166/265 |
| 6,668,925 | B2 * | 12/2003 | Shaw et al. | 166/265 |
| 7,191,830 | B2 | 3/2007 | McVay et al. | |
| 2004/0216886 | A1 * | 11/2004 | Rogers, Jr. | 166/372 |
| 2008/0245525 | A1 * | 10/2008 | Rivas et al. | 166/265 |
| 2009/0014183 | A1 * | 1/2009 | Lembcke et al. | 166/321 |

* cited by examiner

*Primary Examiner*—David J Bagnell
*Assistant Examiner*—Blake Michener
(74) *Attorney, Agent, or Firm*—Bracewell & Giuliani LLP

(57) ABSTRACT

An artificial lift deployed on concentric tubing allows gas to be vented from below packers in a well. A central flow path is used for the fluid production from the artificial lift system, while an outer concentric tubing allows for the venting and production of gas from below a packer. The gas enters the outer concentric flow path through a perforated sub set that is located below the packer. Sealing of the inner concentric string flow from the outer concentric flow path is achieved with a polished bore receptacle and stinger assembly.

18 Claims, 4 Drawing Sheets

SYSTEM, METHOD AND APPARATUS FOR CONCENTRIC TUBING DEPLOYED, ARTIFICIAL LIFT ALLOWING GAS VENTING FROM BELOW PACKERS

BACKGROUND OF THE INVENTION

1. Technical Field

The present invention relates in general to artificial lift for oil and gas wells and, in particular, to an improved system method and apparatus for artificial lift deployed on concentric tubing that allows gas to be vented from below packers in an oil and gas well.

2. Description of the Related Art

In oil and gas wells, artificial lift systems (e.g., pumps) are used to extract the fluid from the wells. In some wells, the pumps are set in the casing below the packers where it is typical to only draw down the wells to no more than the "bubble point." The bubble point is the pressure at which gas vapor first separates from a fluid. When the pressure remains above the bubble point, gas does not form below the packer and therefore eliminates the need to vent gas from below the packer. Another conventional design provides a vented packer that allows the gas to escape to the annulus between the casing and the production string that supports the pump so that the gas may be vented to the wellhead at the surface. Venting gas in the annulus, however, results in an inventory of gas build up within the annulus that is typically not considered desirable or acceptable.

FIG. 1 depicts another conventional option where a dual production string extends from the wellhead to the packer 115. One conduit 133 carries the produced fluids from the artificial lift (e.g., motor 121, seal 123, gas separator 127 and pump 125) and another conduit 135 vents the gas from below the packer 115 to the surface. A packer penetrator 116 provides a path for an electrical cable 118 to the motor 121. Both production strings 133, 135 can be fitted with sub-surface safety valves 136 if required.

In well applications where dual strings, vented packers or some alternative solution cannot be used, the artificial lift system is exposed to potential gas lock when "free gas" levels at the pump intake are sufficiently high. This problem forces the well operator to limit the well drawdown and, consequently, the production rate so the bottom hole pressure at the pump remains above the fluid bubble point, thereby preventing a build up of gas below the packer. Moreover, this limitation prevents the use of more efficient rotary or static gas separation techniques, thus limiting the maximum fluid production from the well.

SUMMARY OF THE INVENTION

Embodiments of a system, method, and apparatus for artificial lift deployed on concentric tubing that allows gas to be vented from below packers in a well are disclosed The system allows for the easy deployment of an artificial lift system (e.g., an electrical submersible pump, or ESP) with the added benefit of two concentric flow paths. A central flow path is used for the fluid production from the artificial lift system, while an outer concentric tubing allows for the venting/production of gas build up from below a packer. The gas enters the outer concentric flow path through a perforated sub set that is located below the packer. Sealing of the inner concentric string flow from the outer concentric flow path is achieved with a polished bore receptacle and stinger assembly.

The artificial lift system is deployed below the packer which inherently prevents the venting of any separated gas between it and the ESP inlet. The perforated sub is above the ESP but below the packer to allow free gas to enter the annulus between the perforated sub and the fluid production tubing installed within the perforated sub. The fluid production tubing is sealed by means of a stinger in a polished bore receptacle between the perforated sub and the top of the ESP. The ESP fluid production stream flows up the inner production tubing to the surface. The annulus between the outer production tubing and the inner production tubing conveys separated gas and a certain amount of liquid carry over to be produced to the surface.

The ESP and the outer production tubing are installed to the pump setting depth and the packer is set. The inner production string is then run in with a separate operation with a sufficiently long stinger to ensure seal engagement when landing off the string at the wellhead. In applications where sub-surface safety valves are required, they may be installed on the inner production tubing with control lines supported by it up to the surface. The annular safety valve may be set below the inner production tubing safety valve.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the present invention are attained and can be understood in more detail, a more particular description of the invention briefly summarized above may be had by reference to the embodiments thereof that are illustrated in the appended drawings. However, the drawings illustrate only some embodiments of the invention and therefore are not to be considered limiting of its scope as the invention may admit to other equally effective embodiments.

DETAILED DESCRIPTION OF THE INVENTION

Figure 1:
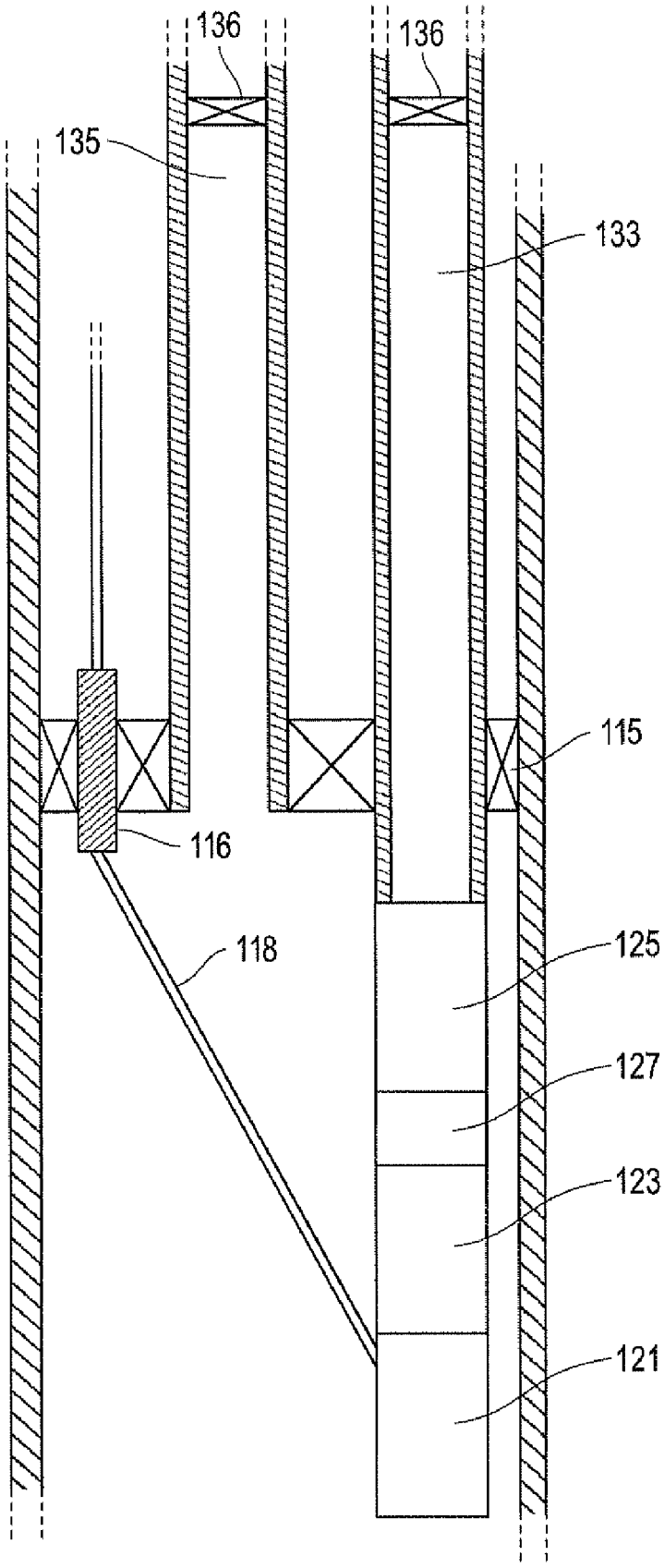
FIG. 1 (Prior Art)
FIG. 1 is a sectional side view of a well fitted with a conventional artificial lift system.
Figure 2:
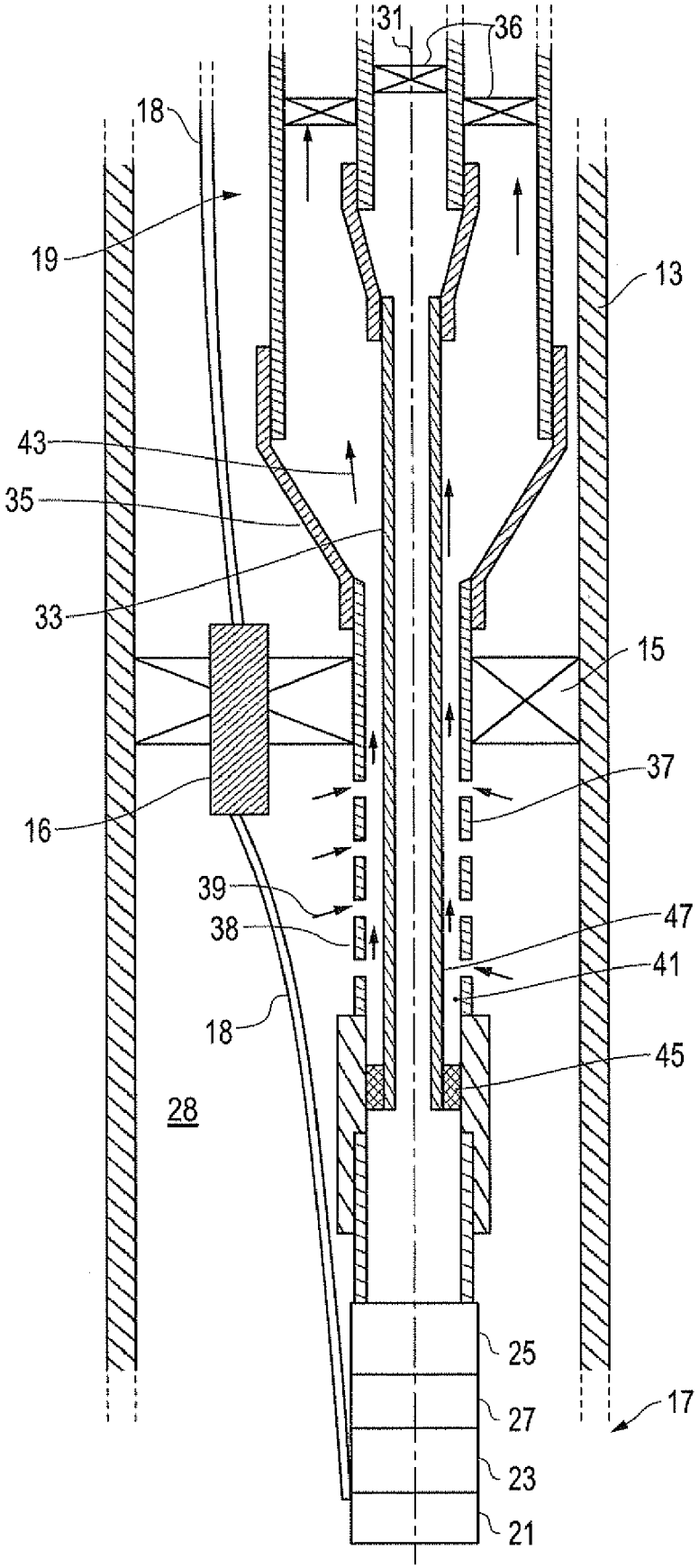
FIG. 2 is a sectional side view of one embodiment of an artificial lift system constructed in accordance with the invention.
Figure 3:
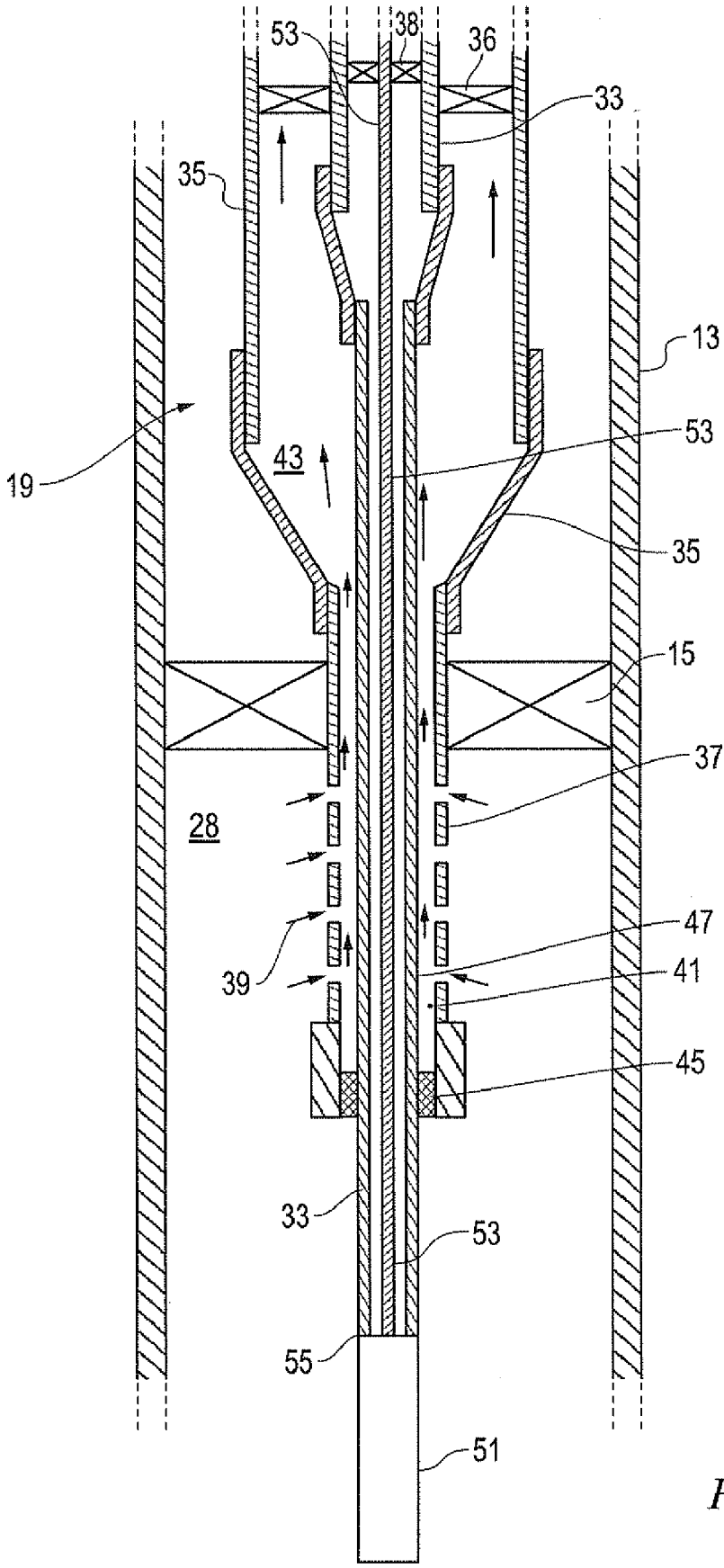
FIG. 3 is a sectional side view of another embodiment of an artificial lift system constructed in accordance with the invention.
Figure 4:
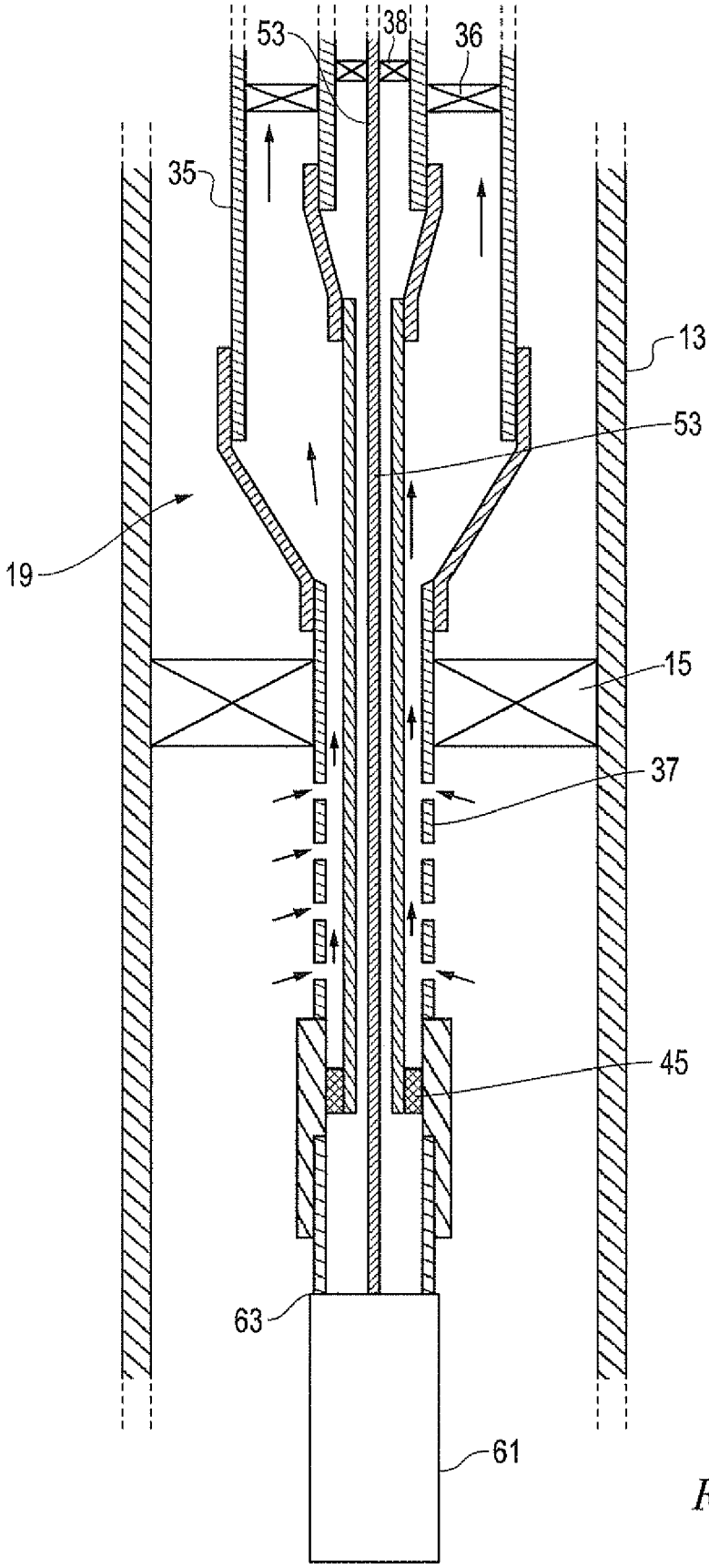
FIG. 4 is a sectional side view of a third embodiment of an artificial lift system constructed in accordance with the invention.

Referring to FIGS. 2-4, embodiments of a system, method and apparatus for an artificial lift deployed on concentric tubing that allows gas to be vented from below a packer in a well are illustrated. The invention permits the use of alternative gas separation techniques to provide more advantageous gas venting systems.

For example, in the well system of FIG. 2, the invention comprises a well 11 having casing 13 installed therein and a packer 15 mounted in the casing 13. An artificial lift, such as an electrical submersible pump (ESP) 17 (e.g., a centrifugal or progressive cavity pump), is mounted to a tubing string 19 that extends from a surface of the well 11. The artificial lift or ESP 17 is located below the packer 15. The ESP 17 may comprise a motor 21, seal section 23 and pump 25. The ESP 17 may further comprise a gas separator 27 for separating gas from the fluid and releasing gas into a casing annulus 28 between the casing 13 and tubing string 19 (e.g., a perforated sub 37).

The tubing string comprises an axis 31 and inner tubing 33 and outer tubing 35 that, in the embodiment shown, are concentric with each other and the axis 31. The inner tubing 33 provides a fluid flow path from the artificial lift 17, through the packer 15, and to the well surface. The inner tubing 33 is free of contact with the packer 15, as shown. The outer tubing 35 extends from the artificial lift 17 to the well surface.

The outer tubing 35 has a perforated sub 37 that is located below the packer 15 for allowing gas ingress 39 into a lower annulus 41 between the perforated sub 37 and the inner tubing 33 as shown. The gas then flows to the well surface via an upper annulus 43 that is located between the inner and outer tubing 33, 35. The inner tubing 33 and the outer tubing 35 may be sealed from each other with a polished bore receptacle 45 and stinger assembly 47. The system is operable with or without sub-surface safety valves. For example, the sub-surface safety valves 36 may be installed as shown in FIG. 2. There may be some well applications, however, where no safety valves are considered necessary.

In other embodiments, the invention also comprises a method of operating a well. For example, the method may comprise providing a well with casing; installing an electrical submersible pump (ESP) and outer production tubing to a pump setting depth in the casing; setting a packer in the casing above the ESP and the pump setting depth; running an inner production tubing inside the outer tubing with a separate operation and with a stinger that sealing engages the ESP; providing a fluid flow path with the inner tubing from the ESP, through the packer, and to a well surface, the inner tubing being free of contact with the packer; and providing the outer tubing with a perforated sub located below the packer for allowing gas ingress into a lower annulus between the perforated sub and the inner tubing, and then to the well surface via an upper annulus between the inner and outer tubing.

In one embodiment, the outer and inner tubing are crossed over to smaller tubing sizes above the packer to make space available for a packer penetrator 16 for an ESP power cable 18. Production at the wellhead may be co-mingled. On the surface there may be only one production manifold available to transport the produced fluid and the gas. It may therefore be necessary to co-mingle the production of fluid and gas at the surface due to the facility constraints. If, however, the facilities are constructed in such a way as to allow individual handling of the fluid and gas separately, then the fluid and gas need not be co-mingled.

The method may further comprise installing one or more sub-surface safety valves 36 (FIG. 2) in the inner tubing with control lines supported by the inner production tubing up to the surface of the well. In some embodiments, the sub-surface safety valves are annular and set within the outer production tubing below the inner production tubing safety valve, with control lines supported by outer production tubing up to the surface of the well.

In other embodiments, the method comprises retaining the power cable 18 by cross-coupling cable clamps on the outer tubing 35, wherein the power cable 18 penetrates the packer 15 to supply power down to the motor 21 of the ESP. As depicted in FIG. 2, the concentric inner and outer tubings 33, 35 may be offset from an axis of the casing 13 to make room for the packer penetrator 16, which is also off-axis relative to casing 13.

As shown in FIGS. 3 and 4, the ESP may be a rod-driven progressive cavity pump (PCP) 51 set below the inner tubing stinger 47. The drive rod 53 for the PCP 51 is located within the inner tubing 33. Safety valve 38 allows penetration of the drive rod 53 through the packer 15, and sub-surface safety valves 36 also are employed. In this example, a stator of the PCP 51 may be wire line deployed within the inner tubing 33, or (as shown) fixed to the end 55 of the inner tubing 33. Alternatively, the inner tubing 33 may comprise coiled tubing.

In some embodiments (FIG. 3), the outer diameter of the PCP 51 is smaller than the inner diameter of the polished bore receptacle 45. This configuration allows the installed PCP 51 to be replaced by removal of the coiled inner tubing 33 without having to remove the outer tubing 35. However, in the embodiment of FIG. 4, when the outer diameter of PCP 61 is equal to or greater than the inner diameter of the polished bore receptacle 45. In this configuration, the PCP 61 is set on the end 63 of the tubing string 19.

The ESP and the outer production tubing are installed to the pump setting depth and the packer is set. For electric submersible pumps (e.g., centrifugal or progressive cavity pump (PCP)), the power cable may be retained by cross-coupling cable clamps on the outer production tubing. The cable penetrates the packer to supply power down to the motor of the ESP. The inner production string is then run in with a separate operation with a sufficiently long stinger to ensure seal engagement when landing off the string at the wellhead.

Depending upon the space available within the well casing, the outer and inner production tubing may be crossed over to smaller tubing sizes above the packer to make space available for the ESP power cable packer penetrator. Production at the wellhead may be co-mingled if desired. In applications where sub-surface safety valves are required, they may be installed on the inner production tubing with control lines supported by it up to the surface. The annular safety valve may be set below the inner production tubing safety valve.

In alternate embodiments, this configuration may be used to set a rod-driven PCP below the inner production tubing stinger, and have the drive rods within the inner production tubing. A safety valve allowing for the penetration of the drive rods through the packer would be required within the inner production tubing in the event that sub-surface safety valve systems are required. The stator of the PCP may be fixed to the end of the inner production tubing, which may comprise coiled tubing.

While the invention has been shown or described in only some of its forms, it should be apparent to those skilled in the art that it is not so limited, but is susceptible to various changes without departing from the scope of the invention.

What is claimed is:

1. A well system, comprising;

a well having casing installed therein and a packer mounted in the casing;

an artificial lift mounted to a tubing string assembly extending from a surface of the well, the artificial lift being located below the packer, the tubing string assembly comprising:

an outer tubing extending to the well surface, the outer tubing having a perforated sub located below the packer and a polished bore receptacle located below the perforated sub;

an inner tubing within the outer tubing, the inner tubing having a stinger that stabs into sealing engagement with the polished bore receptacle, providing a flow path for fluid pumped by the artificial lift through the inner tubing, the perforated sub providing a flow path for gas in the casing to flow up an inner annulus between the inner and outer tubing; and wherein the artificial lift is secured to the stinger and has an outer diameter smaller than an inner diameter of the outer tubing, so that the artificial lift may be installed by lowering it on the inner tubing through the outer tubing.

2. A well system according to claim l, wherein the artificial lift comprises an electrical submersible pump (ESP) comprising one of a centrifugal and progressive cavity pump.

3. A well system according to claim 1, further comprising a sub-surface safety valve installed in the inner tubing above the packer, and a sub-surface safety valve installed in the outer tubing above the packer.

4. A well system according to claim 1, wherein the artificial lift comprises a gas separator for separating gas from the fluid and releasing gas into a casing annulus between the casing and the perforated sub.

5. A well system according to claim 1, further comprising a sub-surface safety value in the inner tubing and a sub-surface valve in the outer tubing.

6. A well system according to claim 1, wherein the artificial lift comprises a rod-driven progressive cavity pump (PCP), and the drive rod is within the inner tubing.

7. A well system according to claim 6, wherein a stator of the PCP is fixed to an end of the inner tubing.

8. A well system according to claim 1, wherein the inner tubing is coiled tubing.

9. A well system, comprising;

a well having casing installed therein and a packer mounted in the casing;

an artificial lift mounted to a tubing string extending from a surface of the well, the artificial lift being located below the packer; the tubing string comprising:

an axis;

an inner tubing concentric with the axis and providing a fluid flow path from the artificial lift, through the packer, and to the well surface; and an outer tubing concentric with the axis and the inner tubing, the outer tubing extending from the artificial lift to the well surface, the outer tubing having a perforated sub located below the packer for allowing gas ingress into a lower annulus between the perforated sub and the inner tubing and then to the well surface via an upper annulus between the inner and outer tubing; and wherein the outer and inner tubing are crossed over to smaller tubing sizes above the packer to make space available for a power cable packer penetrator.

10. A method of operating a well, comprising:

providing a well with casing;

installing an outer tubing in the casing, the outer tubing having a section containing an inlet aperture in its side-wall;

setting a packer between the outer tubing and the casing above the inlet aperture;

securing an artificial lift device to a lower end of a string of inner tubing and running the inner tubing and the artificial lilt device inside the outer tubing, defining an inner annulus between the inner tubing and the outer tubing, and forming an inner annulus seal between the inner tubing and the outer tubing below the inlet aperture; operating the artificial lift device to deliver well fluid through the inner tubing to a surface of the well; and allowing gas in the casing below the packer to flow into the inlet aperture and up the inner annulus to the surface of the well.

11. A method according to claim 10, wherein the artificial lift device comprises a progressive cavity pump.

12. A method according to claim 10, wherein forming an inner annulus seal comprises stabbing a stinger of the inner tubing into a polished bore receptacle mounted in the outer tubing.

13. A method according to claim 10, further comprising installing a sub-surface safety in the inner tubing above the packer.

14. A method according to claim 10, wherein the artificial lift device comprises a gas separator for separating gas from the fluid and releasing gas into the casing below the inlet aperture.

15. A method according to claim 10, wherein the outer and inner tubing are crossed over to smaller tubing sizes above the packer to make space available for an ESP power cable packer penetrator.

16. A method according to claim 10, further comprising installing a sub-surface safety value in the inner tubing and installing a sub-surface safety valve in the outer tubing.

17. A method according to claim 10, wherein the artificial lift device comprises a rod-driven progressive cavity pump (PCP), and before operating the lift device, the method further comprises lowering a string of drive rods through the inner tubing to the PCP.

18. A method according to claim 17, wherein a stator of the PCP is fixed to an end of the inner tubing, and the inner tubing is coiled tubing.

* * * * *